US005507062A

United States Patent [19]

Salecker

[11] Patent Number: 5,507,062

[45] Date of Patent: Apr. 16, 1996

[54] SEALING STRUCTURE ON A MECHANISM FOR ADVANCING A ROTATING CYLINDRICAL MEMBER

[75] Inventor: Roy W. Salecker, Mendota, Ill.

[73] Assignee: Spartan Tool Div. of Pettibone Corp., Mendota, Ill.

[21] Appl. No.: 409,773

[22] Filed: Mar. 24, 1995

[51] Int. Cl.[6] ..... B08B 9/02

[52] U.S. Cl. ..... 15/104.33; 74/25

[58] Field of Search ..... 15/104.33; 226/174, 226/181, 190; 74/25

[56] References Cited

U.S. PATENT DOCUMENTS 3,394,599 7/1968 Tucker ..... 15/104.33
4,686,732 8/1987 Irwin ..... 15/104.33
5,239,724 8/1993 Salecker et al. ..... 15/104.33

*Primary Examiner*—Edward L. Roberts, Jr.
*Attorney, Agent, or Firm*—Wood, Phillips, VanSanten, Clark & Mortimer

[57] ABSTRACT

A mechanism for advancing a rotating cylindrical member, which mechanism includes a frame having an opening with a first axis to accept a cylindrical member extending therethrough in a first line, an advancing roller for engagement with a cylindrical member extending through the frame opening, first structure for mounting the advancing roller for movement relative to the frame with the first structure including a mounting block on the frame having a passage and a carrier for the advancing roller that is movable guidingly in the mounting block passage in a path in first and second opposite directions, and sealing structure cooperating between the carrier and the mounting block for blocking migration of foreign matter into the mounting block passage.

20 Claims, 3 Drawing Sheets

SEALING STRUCTURE ON A MECHANISM FOR ADVANCING A ROTATING CYLINDRICAL MEMBER

BACKGROUND OF THE INVENTION

1. Field of the Invention

This invention relates to a mechanism for controllably advancing a rotating cylindrical member and, more particularly, to a sealing structure that prevents migration of foreign matter between relatively movable parts on the mechanism.

2. Background Art

It is well known to use multiple advancing rollers to controllably convey a rotating, cylindrical member, such as a sewer cable. Exemplary mechanisms are shown in each of U.S. Pat. Nos. 3,394,599, 3,451,090, and 5,239,724. In each mechanism, a plurality of advancing rollers surround and are abutted to a rotating cable. With the rotational axes for the advancing rollers parallel to the length of the cable, the system is in a neutral or idling state. The rollers are simultaneously repositionable to cause the roller axes to align transversely to the lengthwise axis of the cable. The canted rollers acting on the outer surface of the rotating cable effect advancement thereof in a direction and at a rate determined by the angle between the roller axes and the cable length.

Each of the advancing rollers is mounted to a carrier which is moved in a passage defined by a mounting block. The passage is bounded by a surface which guides the carrier both in rotation about the center axis of the passage and in translation axially of the passage.

In operation, the rollers contact the outer surface of the rotating cable and thereby tend to dislodge foreign matter therefrom. This foreign matter, in the form of grime and particulate, tends to find its way into the passage between the carrier and the inner block surface. Ultimately, the accumulation of foreign matter within the passage may inhibit canting of the rollers through rotation of the carriers. In an extreme case, the carriers may lock up in the blocks.

It is known to provide a grease fitting on the mounting block and to introduce grease under pressure into the passageway so as to squeeze particulate and grime outwardly oppositely to the direction in which it gained entry. In so doing, the carrier becomes lubricated to allow freedom of movement.

One problem with this conventional system is that it is virtually impossible to control the incoming grease so that it fully flushes the grime and particulate away from the passageway. Instead, some of the lubricant commonly causes the particulate and grime to move oppositely to the desired direction and lodge in bearings in the passage at the closed axial ends thereof. Needle bearings, which are commonly used at the closed end of the passage to guide rotation of the carriers, are prone to locking up when exposed to this type of foreign material.

Further, it is an inconvenience to have to periodically maintain the unit by introducing grease. If maintenance is postponed, damage to the unit, i.e., the needle bearings, might occur, necessitating replacement thereof.

As an alternative to introducing grease, it is also known to disassemble the carrier and block assembly to facilitate cleaning thereof. This is highly inconvenient, particularly when this cleaning must take place in the field.

SUMMARY OF THE INVENTION

The present invention is specifically directed to overcoming the above enumerated problems in a novel and simple manner.

In one form of the invention, a mechanism is provided for advancing a rotating cylindrical member, which mechanism includes a frame having an opening with a first axis to accept a cylindrical member extending therethrough in a first line, an advancing roller for engagement with a cylindrical member extending through the frame opening, first structure for mounting the advancing roller for movement relative to the frame with the first structure including a mounting block on the frame having a passage and a carrier for the advancing roller that is movable guidingly in the mounting block passage in a path in first and second opposite directions, and sealing structure cooperating between the carrier and the mounting block for blocking migration of foreign matter into the mounting block passage.

In one form, the passage is bounded by a cylindrical inner surface and the carrier has a cylindrical outer surface, with the sealing structure cooperating between the inner and outer surfaces.

At least one of the inner and outer surfaces may have an undercut, with the sealing structure including a sealing member residing at least partially within the undercut.

The sealing member may extend partially or continuously around the at least one of the inner and outer surfaces.

The sealing member may be an O-ring, made from a resilient material such as rubber.

In one form, the passage has a second axis extending transversely to the first axis and first and second ends spaced axially with respect to the second axis, with the first end being closer to the first axis than the second end. The sealing structure blocks migration of foreign matter through the first end of the passage to the second end of the passage.

The carrier has a central axis that is transverse to the first axis, an outer surface matched to an inner surface bounding the passage on the mounting block, and axially spaced third and fourth ends, with the third end being closer to the first axis than the fourth end. In one form, the sealing structure is closer to the third end of the outer surface than it is to the fourth end of the outer surface.

The sealing structure may be adjacent to the third end of the outer surface of the carrier.

There may be a second advancing roller for engagement with a cylindrical member extending through the frame opening, second structure for mounting the second advancing roller for movement relative to the frame, with the second structure including a second mounting block on the frame having a second passage and a second carrier for the second advancing roller that is movable guidingly in the second passage selectively in third and fourth opposite directions, and second sealing structure cooperating between the second carrier and the second mounting block for blocking migration of foreign matter into the second mounting block passage.

In another form of the invention, an advancing roller subassembly is provided for a mechanism for advancing a rotating cylindrical member. The advancing roller subassembly has a carrier with a central axis and an outer surface to act against a complementary surface to thereby guide movement of the carrier in a predetermined path relative to the complementary surface, a roller, structure for mounting the roller to the carrier for rotational movement of the roller relative to the carrier about an axis that is transverse to the central axis, and sealing structure acting between the outer surface of the carrier and the complementary surface to block migration of foreign matter between the outer surface of the carrier and a complementary surface.

The predetermined path may be at least one of a) substantially parallel to the central axis of the carrier and b) rotational around the central carrier axis.

The outer surface of the carrier may have a substantially cylindrical configuration and may be undercut to accommodate the sealing structure.

The outer surface has axially spaced first and second ends with the first axially spaced end being closer to the roller than the second axially spaced end and the sealing structure on the outer surface of the carrier is closer to the first axial end of the outer surface than it is to the second axial end of the outer surface.

DETAILED DESCRIPTION OF THE DRAWINGS

Figure 1:
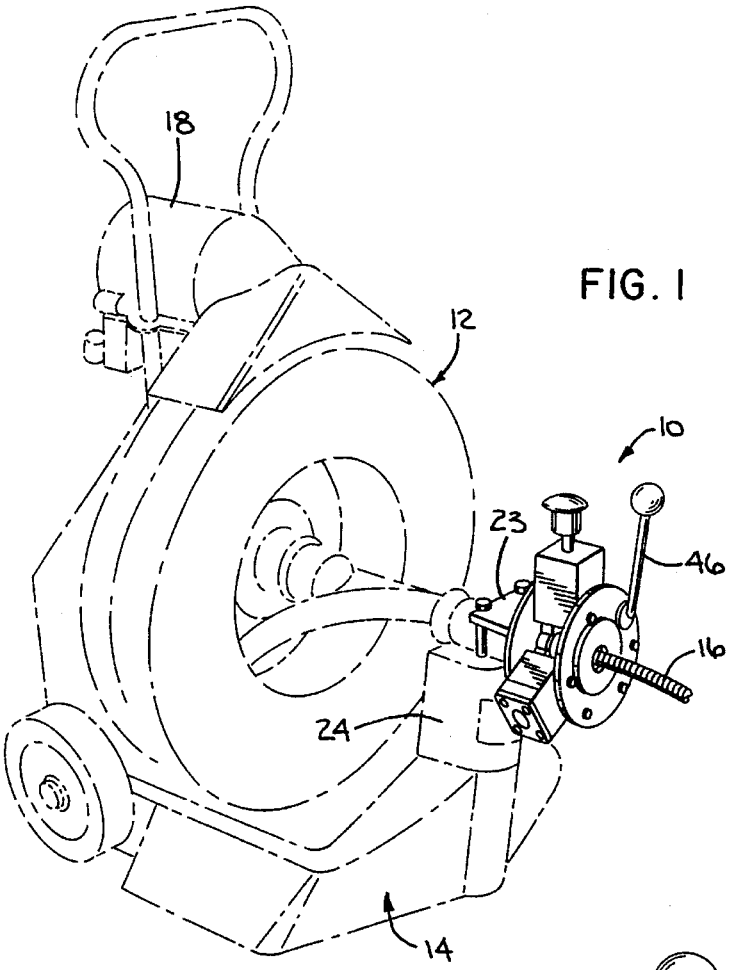
FIG. 1 is a perspective view of a mechanism for advancing a rotating cylindrical member, with the present invention incorporated therein and operatively connected to a sewer cable supporting drum.

In FIG. 1, a mechanism for advancing a rotating cylindrical member, according to the present invention, is shown at 10, operatively associated with a cable drum 12 on a wheeled cart 14 which facilitates transportation of the drum 12. The drum 12 carries a supply of conventional sewer cable 16 and is mounted for rotation by a motor 18 relative to the mobile cart 14.

Figure 3:
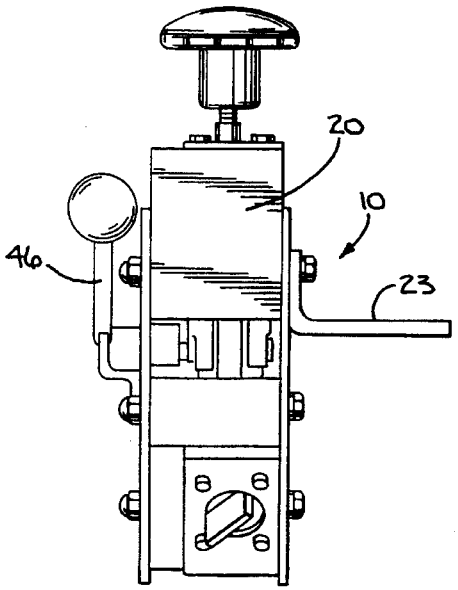
FIG. 3 is an enlarged, side elevation view of the inventive advancing mechanism.
Figure 2:
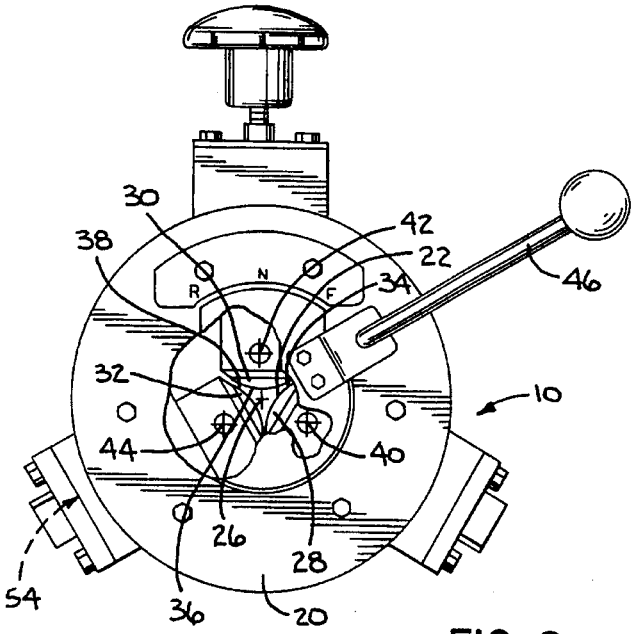
FIG. 2 is an enlarged, front elevation view of the inventive advancing mechanism.

As seen also in FIGS. 2 and 3, the mechanism 10 has a frame 20 defining an opening 22 through which the cable 16 is directed for advancement thereof in a line substantially parallel to the length of the cable 16. The mechanism 10 has a rigid bracket 23 that is fixedly mounted upon an upright support 24 on the cart 14 so that the rotational axis of the drum 12 coincides with the central axis 26 of the frame opening 22. Advancing rollers 28, 30, 32 project into the frame opening 22 and have peripheral surfaces 34, 36, 38 which cooperatively define an effective diameter for receipt of the cable 16.

The rollers 28, 30, 32 rotate relative to the frame 20 about spaced axes 40, 42, 44, consecutively. With the axes 40, 42, 44 parallel to the axis 26 of the frame opening 22, the device is in the "neutral" position. That is, the cable 16 being rotated by the drum 12 effects rotation of the rollers 28, 30, 32 without the cable 16 being withdrawn into the drum 12 or advanced therefrom. Through a control arm 46, the axes 40, 42, 44 for the rollers 28, 30, 32 can be reoriented. With the control arm 46 moved to a forward advance position, shown in FIG. 2, the roller axes 40, 42, 44 are uniformly angled relative to the frame opening axis 26 to thereby define a helical engagement path which results in the advancement of the cable 16 forwardly out of the drum 12. Pivoting of the control arm 46 through approximately 90°, in a counterclockwise direction in FIG. 2, places the advancing mechanism 10 in a reverse mode position. In this mode, the axes 40, 42, 44 are simultaneously repositioned through approximately 90° from the position they occupy with the arm 46 in the forward position. This results in the advancement of the cable 16 in a reverse direction, i.e., back into the drum 12.

It is not necessary to understand the details of the control mechanism that effects angular reorientation of the rollers 28, 30, 32 to fully comprehend the present invention. A suitable mechanism through which this angular reorientation of the rollers 28, 30, 32 can be accomplished is shown in U.S. Pat. No. 3,394,599, with another relevant structure shown in U.S. Pat. No. 3,451,090. The disclosure in both of these patents is incorporated herein by reference.

Figure 4:
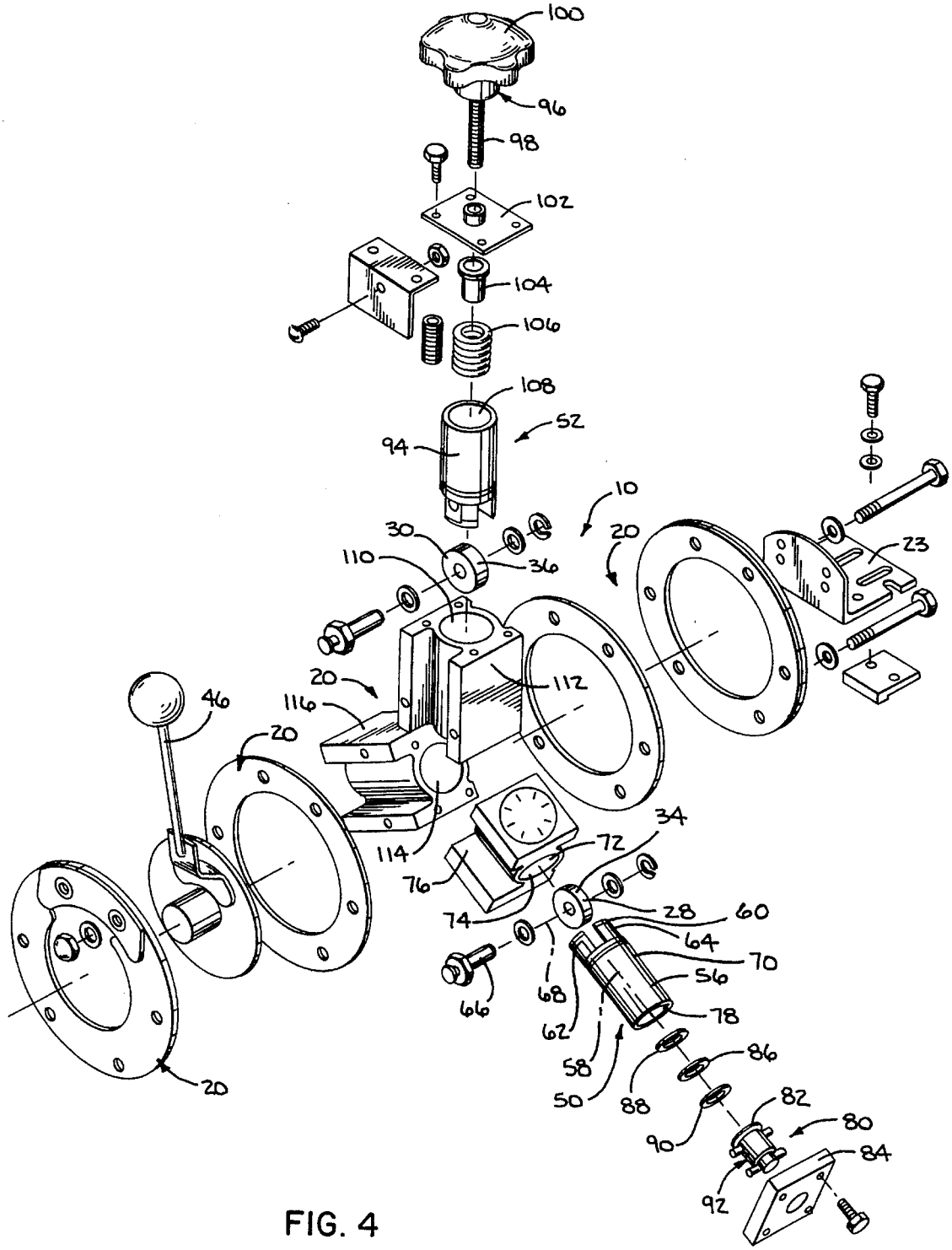
FIG. 4 is an exploded perspective view of the inventive advancing mechanism.
Figure 5:
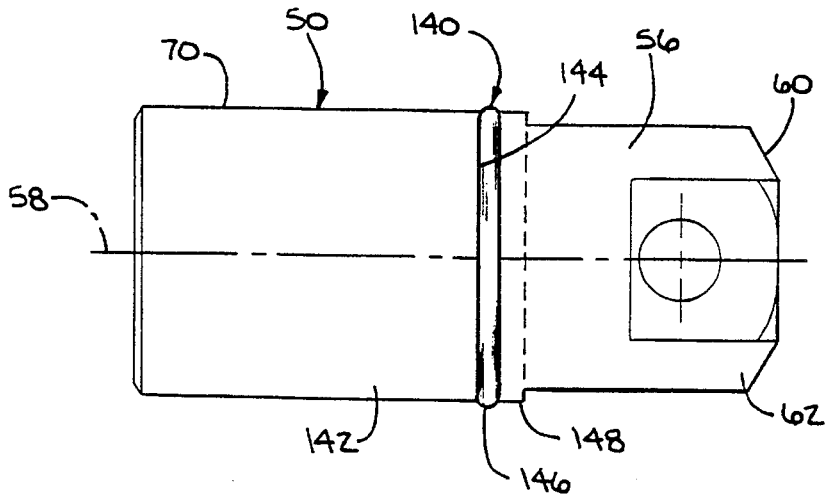
FIG. 5 is an enlarged, front elevation view of a roller carrier on the inventive advancing mechanism.

The present invention, as seen most clearly in FIGS. 4 and 5, is concerned principally with the subassemblies for both angularly repositioning the advancing rollers 28, 30, 32 and moving the advancing rollers 28, 30, 32 towards and away from the central axis 26, to thereby accommodate cables 16 of different diameter. In the embodiment shown, there are three such advancing roller subassemblies 50, 52, 54. Two of the subassemblies, 50, 54 are the same, while the third subassembly 52 is slightly different.

The subassembly 50 will be described as representative of the two similar subassemblies 50, 54. The subassembly 50 includes a generally cylindrical carrier 56 having a central axis 58. The carrier 56 is bifurcated at one axial end 60 thereof to define spaced legs 62, 64 between which the advancing roller 28 is captively fit. A pin 66 projects through the legs 62, 64 and the roller 28 therebetween to guide the roller 28 in rotation about an axis 68 at a substantially right angle to the central axis 58 of the carrier 56.

The carrier 56 has a cylindrical outer surface 70 that is guided against an inner surface 72 bounding a through bore 74 on a mounting block 76. The inner surface 72 on the mounting block 76 and outer surface 70 on the carrier 56 cooperate to guide the carrier 56 selectively both lengthwise of the central axis 58 of the carrier 56 and in rotation about the axis 58. This permits adjustment of the carrier 56 to accommodate cables 16 of different diameter and also permits the selection of the advancing direction and rate of advancement of the cable 16.

The carrier 56 has an axially outwardly facing surface 78 which is acted upon by an adjusting mechanism at 80 to set the spacing between the peripheral surface 34 of the advancing roller 28 and the frame central axis 26. More particularly, the adjusting mechanism 80 includes a pressure plate 82 which is captive between a cover plate 84 on the mounting block 76 and the surface 78 on the carrier 56. A needle bearing 86 and cooperating hard races 88, 90 are disposed between the surface 78 and the plate 82. By varying the axial position of the plate 82 relative to the cover plate 84, through a mechanism at 92, the spacing between the peripheral surface 34 on the roller 28 and the central axis 26 can be varied. A suitable mechanism 92 for this purpose is disclosed in U.S. Pat. No. 5,239,724, which is also incorporated herein by reference. The other advancing roller subassembly 54 operates in the same manner.

The advancing roller subassembly 52 is somewhat different in that the axial position of a carrier 94 for the roller 30 is adjustable through a threaded actuator 96. The actuator 96 has a threaded stem 98 with an enlarged head to facilitate rotation of the stem 98 within a bracket 102, fixed to the frame 20. The stem 98 is in turn threaded into a plunger 104 which bears against a coil spring 106 that is received within a recess 108 defined by the carrier 94. Through this arrangement, the advancing roller 30 on the carrier 94 can be biasably urged against the cable 16.

In operation, twenty to twenty-five foot pounds of pressure are applied through the roller 30 to the cable 16. As the cable 16 rotates, all of the rollers 28, 30, 32 scrape the outer surface of the cable 16 and tend to throw foreign matter into the through bore/passage 74 between the carrier 56 and surface 72 on the mounting block 76 and into the corresponding through bore/passageway 110 on the mounting block 112 and the through bore/passageway 114 on the mounting block 116. The progressive buildup of foreign matter in the mounting blocks 76, 112, 116 may ultimately cause jamming of the carriers 56, 94. Once this occurs, one way of remedying the problem is to take apart each of the subassemblies 50, 52, 54 and wash the parts thereof and particularly the thrust bearings 86. Aside from the inconvenience of doing this, by the time that the subassemblies 50, 52, 54 jam, damage may have already been inflicted on the thrust bearings 86.

Figure 6:
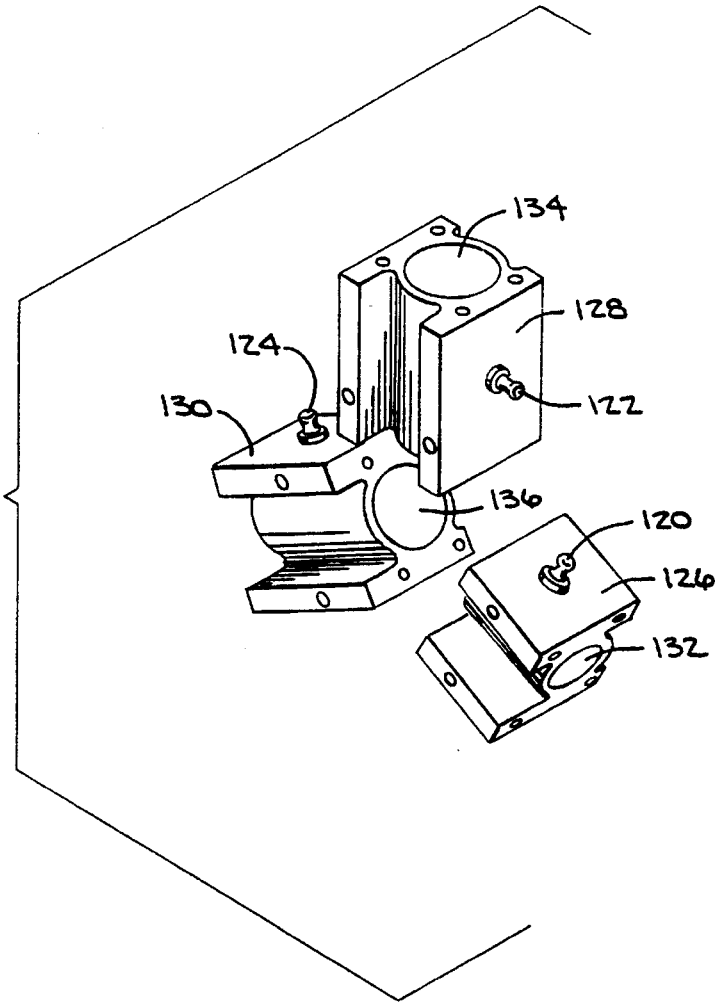
FIG. 6 (PRIOR ART)
FIG. 6 is a perspective view of a plurality of mounting blocks in a prior art mechanism for advancing a rotating cylindrical member.

Another solution to this problem has been to provide grease fittings 120, 122, 124 on the mounting blocks 126, 128, 130, as shown in FIG. 6. The grease fittings 120, 122, 124 are located in between the axial ends of the mounting blocks 126, 128, 130 to facilitate access thereto. The grease fittings 120, 122, 124 communicate from externally of the mounting blocks 126, 128, 130 to within the passageways 132, 134, 136.

While one of the objectives of this type of system is to cause the input grease to flush out and lubricate within the passageways 132, 134, 136, the grease may also force the foreign matter into the needle thrust bearing assemblies (not shown), corresponding to those 86, 88, 90 in the inventive mechanism 10. Ultimately, the bearing assemblies may fail or may have to be removed and cleaned, as described above.

To obviate this problem, a sealing means is provided at 140 on the subassembly 50, with a similar arrangement being provided on each of the subassemblies 52, 54. Referring to the subassembly 50, the sealing means 140 is in the form of a resilient element which surrounds the body 142 of the carrier 56. A radial undercut 144 is provided in the outer surface 70 of the carrier 56 to allow the sealing means 140 to be consistently placed therein and is preferably dimensioned so that the outer surface 146 of the sealing means 140 projects slightly radially outwardly of the surface 70. The sealing means 140 can be any suitable construction and is, in a preferred form, a rubber O-ring which is compressible to allow free rotative and translatory movement of the carrier 56 while sweeping the inner surface 72 of the mounting block 76 as the carrier 56 translates. The sealing means 140 prevents migration of foreign matter into the through bore/passage 74 and between the surfaces 70, 72 on the carrier 56 and mounting block 76, respectively.

To best perform its function, as described above, the sealing means 140 is adjacent to the inner axial end 148 of the surface 70 to minimize exposure of the surface 70 to foreign matter in use. This arrangement obviates the need for disassembly of the subassemblies 50, 52, 54 to effect cleaning thereof and also obviates the need for the grease fittings 120, 122, 124 of the prior art unit, as shown in FIG. 6.

The foregoing disclosure of specific embodiments is intended to be illustrative of the broad concepts comprehended by the invention.

I claim:

1. A mechanism for advancing a rotating cylindrical member, said advancing mechanism comprising:

a frame having an opening to accept a cylindrical member extending therethrough in a first line, said opening having a first axis;

an advancing roller for engagement with a cylindrical member extending through the frame opening;

first means for mounting the advancing roller for movement relative to the frame, said first means including a mounting block on the frame having a passage and a carrier for the advancing roller that is movable guidingly in the mounting block passage selectively in first and second opposite directions; and sealing means cooperating between the carrier and the mounting block for blocking migration of foreign matter into the mounting block passage.

2. The mechanism for advancing a rotating cylindrical member according to claim 1 wherein the passage is bounded by a cylindrical inner surface, the carrier has a cylindrical outer surface and the sealing means cooperates between the inner surface bounding the passage and outer surfaces on the carrier.

3. The mechanism according to claim 2 wherein at least one of the inner surface bounding the passage and outer surfaces on the carrier has an undercut and the sealing means comprise a sealing member residing at least partially within the undercut.

4. The mechanism according to claim 3 wherein the sealing member extends continuously around the at least one of the inner surface bounding the passage and outer surfaces on the carrier.

5. The mechanism according to claim 4 wherein the sealing member comprises an O-ring.

6. The mechanism according to claim 5 wherein the O-ring is made from a resilient material.

7. The mechanism according to claim 5 wherein the O-ring is made from rubber.

8. The mechanism according to claim 1 wherein the passage has a second axis extending transversely to the first axis, and first and second ends spaced axially with respect to the second axis, with the first end being closer to the first axis than the second end is to the first axis and the sealing means blocks migration of foreign matter through the first axial end of the passage to the second axial end of the passage.

9. The mechanism according to claim 8 wherein the carrier has a central axis that is transverse to the first axis and an outer surface matched to an inner surface on the mounting block bounding the passage and having axially spaced third and fourth ends with the third end being closer to the first axis than the fourth end is the first axis and the sealing means is closer to the third axial end of the outer surface than it is to the fourth axial end of the outer surface.

10. The mechanism according to claim 9 wherein the sealing means is adjacent the third axial end of the outer surface of the carrier.

11. The mechanism according to claim 1 wherein there is a second advancing roller for engagement with a cylindrical member extending through the frame opening, second means for mounting the second advancing roller for movement relative to the frame, with the second means including a second mounting block on the frame having a second passage and a second carrier for the second advancing roller that is movable guidingly in the second passage selectively in third and fourth opposite directions and second sealing means cooperating between the second carrier and the second mounting block for blocking migration of foreign matter into the second mounting block passage.

12. An advancing roller subassembly for a mechanism for advancing a rotating cylindrical member, said advancing roller subassembly comprising:

a carrier having a central axis and an outer surface to act against a complementary surface to thereby guide movement of the carrier in a predetermined path relative to a complementary surface;

a roller;

means for mounting the roller to the carrier for rotational movement of the roller relative to the carrier about an axis that is transverse to the central axis; and sealing means on the outer surface of the carrier and adapted to act between the outer surface of the carrier and a complementary surface to block migration of foreign matter between the outer surface of the carrier and a complementary surface.

13. The advancing roller subassembly according to claim 12 wherein the predetermined path is at least one of a) substantially parallel to the central axis of the carrier, and b) rotational around the central carrier axis.

14. The advancing roller subassembly according to claim 12 wherein the outer surface of the carrier has a substantially cylindrical configuration.

15. The advancing roller subassembly according to claim 12 wherein the outer surface of the carrier has an undercut and the sealing means comprises a sealing member residing at least partially within the undercut.

16. The advancing roller subassembly according to claim 15 wherein the sealing member extends continuously around the outer surface of the carrier.

17. The advancing roller subassembly according to claim 16 wherein the sealing member comprises an O-ring.

18. The advancing roller subassembly according to claim 17 wherein the O-ring is made from a resilient material.

19. The advancing roller subassembly according to claim 17 wherein the O-ring is made from rubber.

20. The advancing roller subassembly according to claim 12 wherein the carrier outer surface has first and second ends spaced axially with respect to the central axis of the carrier with the first axially spaced end being closer to the roller than the second axially spaced end and the sealing means is on the outer surface of the carrier and is closer to the first axial end of the outer surface than it is to the second axial end of the outer surface.

* * * * *